US009951465B1

(12) United States Patent
Herschler et al.

(10) Patent No.: US 9,951,465 B1
(45) Date of Patent: Apr. 24, 2018

(54) DRYER APPLIANCE AND SENSOR ASSEMBLY THEREOF

(71) Applicant: Haier US Appliance Solutions, Inc., Wilmington, DE (US)

(72) Inventors: Brad Herschler, Louisville, KY (US); Alex Gottsov, Louisville, KY (US); Tomas Garces, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/331,945

(22) Filed: Oct. 24, 2016

(51) Int. Cl.
*D06F 58/28* (2006.01)
*G06K 7/10* (2006.01)

(52) U.S. Cl.
CPC ..... *D06F 58/28* (2013.01); *G06K 7/10366* (2013.01); *D06F 2058/2819* (2013.01)

(58) Field of Classification Search
CPC .. D06F 58/20; D06F 58/28; D06F 2058/2819; G06K 7/10366
USPC ..... 34/528, 610; 68/19, 20
See application file for complete search history.

(56) References Cited

U.S. PATENT DOCUMENTS 8,572,865 B2 * 11/2013 Beers ..... D06F 58/04 237/2 B
8,650,772 B2 * 2/2014 Son ..... D06F 33/02 34/524
9,080,282 B2 * 7/2015 Zambrowicz ..... D06F 58/04
9,518,354 B2 * 12/2016 Kulkarni ..... D06F 58/28
9,644,311 B2 * 5/2017 Kulkarni ..... D06F 58/28
2009/0083990 A1 * 4/2009 Bae ..... D06F 33/02 34/486
2009/0090137 A1 * 4/2009 Jeong ..... D06F 33/02 68/12.02
2011/0203131 A1 8/2011 Armstrong
2015/0368853 A1 12/2015 Kulkarni et al.
2016/0053427 A1 * 2/2016 Noh ..... D06F 58/28 34/427
2017/0037563 A1 * 2/2017 Kulkarni ..... D06F 58/28

FOREIGN PATENT DOCUMENTS

DE 102008048910 A1 * 5/2009 ..... D06F 33/02
KR 101507783 B1 * 4/2015 ..... D06F 33/02

* cited by examiner

*Primary Examiner* — Stephen M Gravini
(74) *Attorney, Agent, or Firm* — Dority & Manning, P.A.

(57) ABSTRACT

A dryer appliance and sensor assembly are provided. The sensor assembly may include a sensor housing, an appliance sensor, a wireless transmission tag, and a wireless tag reader. The sensor housing may extend within a drum and define a compartment proximate a space for the receipt of clothes. The appliance sensor may be positioned on the sensor housing. The wireless transmission tag may be positioned within the compartment. The wireless transmission tag may be in communication with the appliance sensor. The wireless tag reader may be in operable communication with the wireless transmission tag.

20 Claims, 8 Drawing Sheets

DRYER APPLIANCE AND SENSOR ASSEMBLY THEREOF

FIELD OF THE INVENTION

The present subject matter relates generally to dryer appliances, and more particularly to a dryer appliance having a sensor assembly disposed therein.

BACKGROUND OF THE INVENTION

Dryer appliances generally include a cabinet with a drum mounted therein. In some dryer appliances, a motor rotates the drum during operation of the dryer appliance, e.g., to tumble articles located within a chamber defined by the drum. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance.

In order to provide enhanced control of a clothes dryer appliance, it can be desirable to know one or more conditions (e.g., the moisture content) of clothing being dried by a dryer appliance. For example, the dryer can be operated until it is sensed that the moisture content of the clothing has fallen below a desired amount. The heater or other appropriate components of the dryer appliance can then be de-energized or otherwise controlled accordingly.

Certain existing dryer appliances use two metal rods in parallel or a combination of rods and the drum surface as a sensor to detect available moisture in the clothing. Other sensors for detecting temperature and relative humidity can be added as well to sense internal air properties. These sensors typically receive excitation power from the dryer control board via a physical connection, such as electrical wires. Therefore, the sensors are frequently placed on a non-rotating component of the dryer, such as a door or a fixed back wall.

Placement of the sensors on the rotating components of the dryer, such as the drum or associated lifters or baffles, can result in obtaining more accurate readings at a higher frequency. However, placement of the sensors on the rotating components can present additional problems. For example, wireless communication systems may be required for transmitting data from rotating components to the non-rotating components. However, very little clearance is generally provided or desired between the drum and the cabinet. It can be difficult to mount components proximate to the drum without increasing the overall cabinet size or volume.

Therefore, improved dryer appliances and sensor assemblies thereof are needed.

BRIEF DESCRIPTION OF THE INVENTION

Aspects and advantages of the invention will be set forth in part in the following description, or may be obvious from the description, or may be learned through practice of the invention.

In one aspect of the present disclosure a sensor assembly to a dryer appliance is provided. The sensor assembly may include a baffle, an appliance sensor, a wireless transmission tag, and a wireless tag reader. The baffle may include a baffle having a baffle body that defines a lifting face and a non-lifting face. A compartment may be defined within the baffle body between the lifting face and the non-lifting face. The appliance sensor may be positioned on the baffle body.

The wireless transmission tag may be positioned within the compartment. The wireless transmission tag may be in communication with the appliance sensor. The wireless tag reader may be in operable communication with the wireless transmission tag.

In another aspect of the present disclosure a dryer appliance is provided. The dryer appliance may include a cabinet, a drum, a sensor housing, an appliance sensor, a wireless transmission tag, and a wireless tag reader. The drum may be rotatably mounted within the cabinet. The drum may define a space for the receipt of clothes for drying. The sensor housing may extend within the drum. The sensor housing may define a compartment proximate the space for the receipt of clothes. The appliance sensor may be positioned on the sensor housing. The wireless transmission tag may be positioned within the compartment in communication with the appliance sensor. The wireless tag reader may be in operable communication with the wireless transmission tag.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
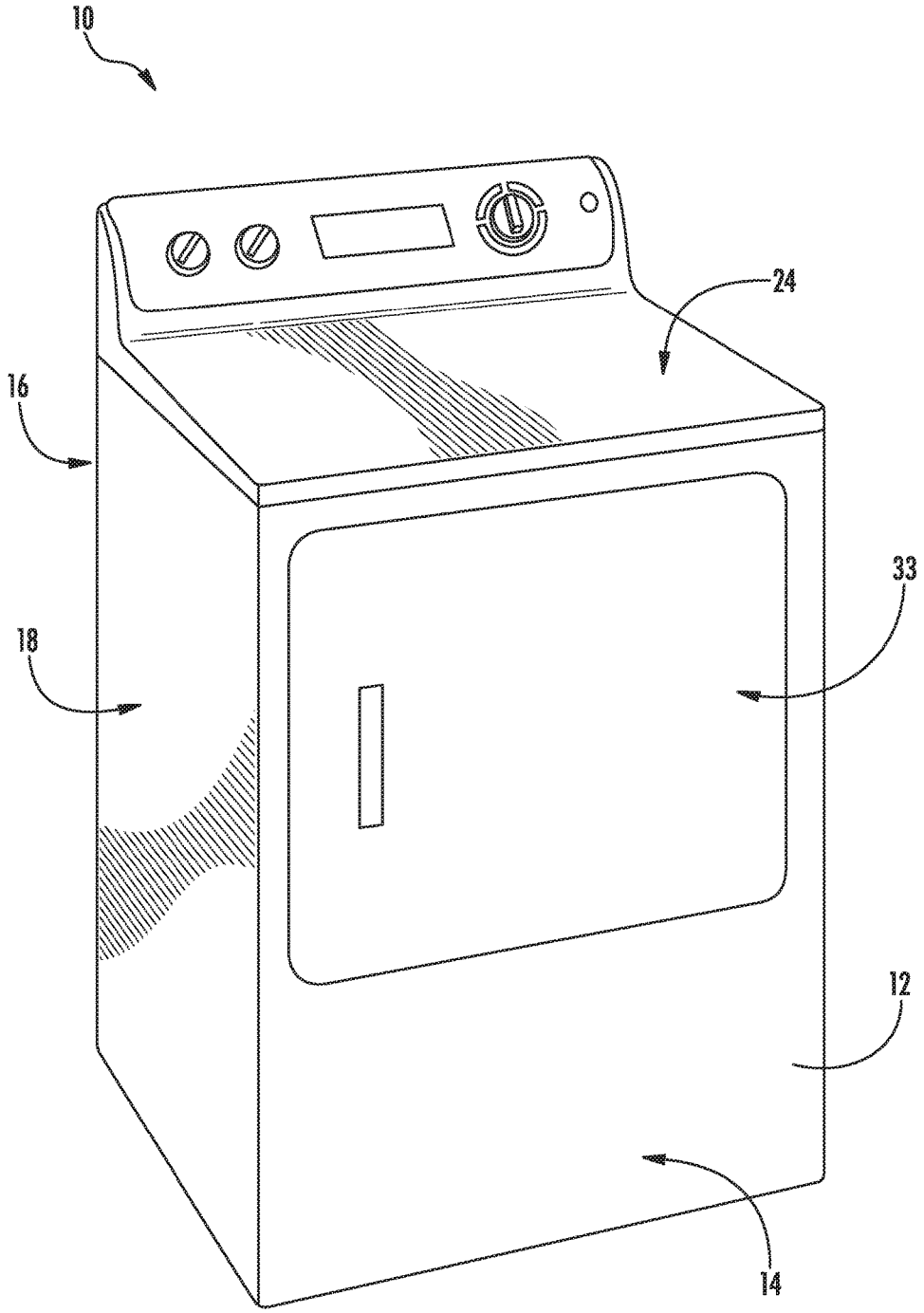
FIG. 1 provides a perspective view of a dryer appliance in accordance with an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In some aspects of the present disclosure, a dryer appliance that includes a sensor assembly is provided. A sensor may be positioned on a sensor housing that extends into a drum of the dryer appliance. A wireless transmission tag is generally positioned within the baffle and can communicate with the sensor. A wireless tag reader is positioned outside of the baffle, but can communicate with the wireless transmission tag to receive information or data signals regarding a condition within the drum.

Figure 2:
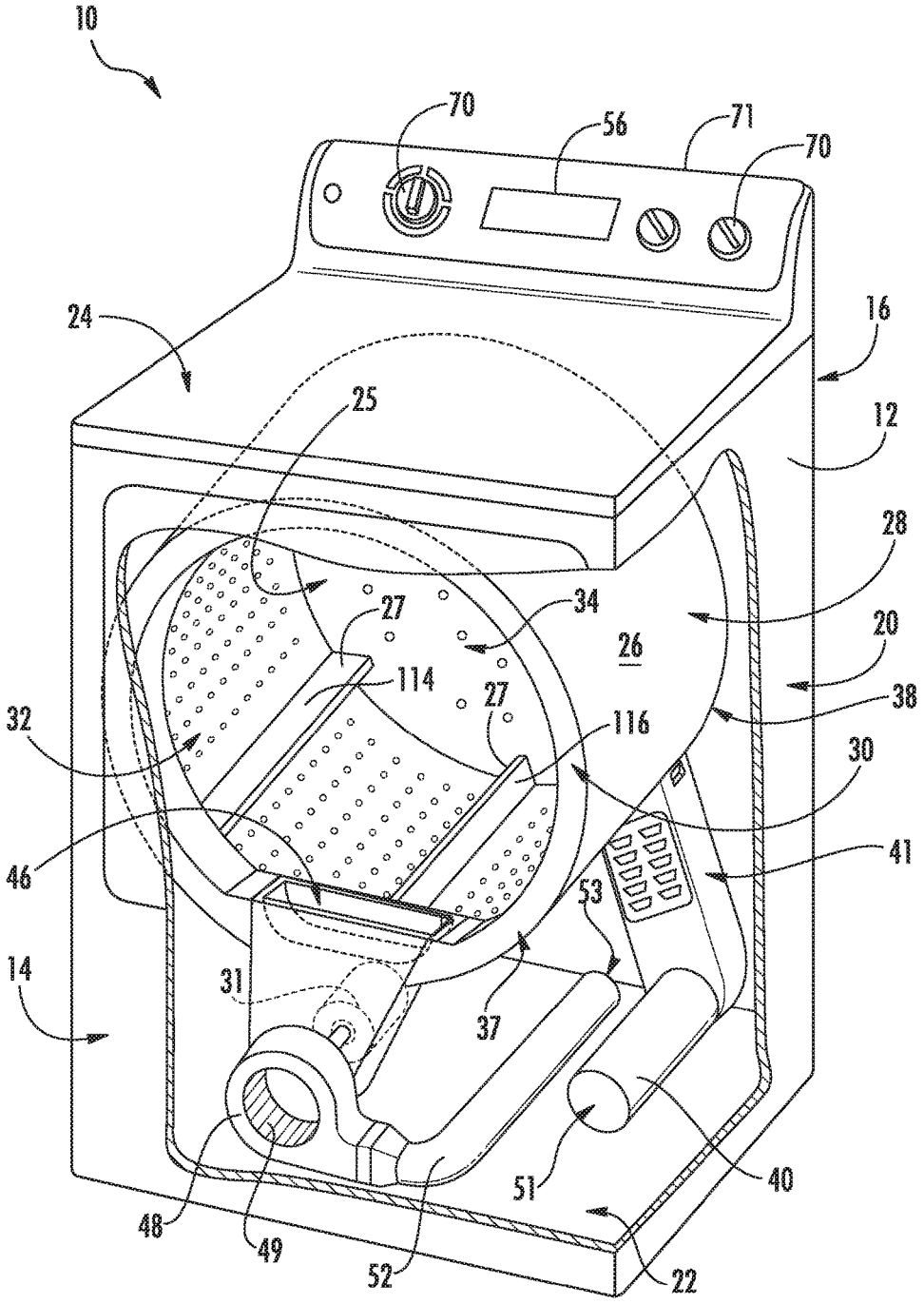
FIG. 2 provides a perspective view of the example dryer appliance of FIG. 1 with portions of a cabinet of the dryer appliance removed to reveal certain components of the dryer appliance.

Turning now to the figures, FIG. 1 provides dryer appliance 10 according to an example embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein, it will be understood that dryer appliance 10 is provided by way of example only. Other dryer appliances having different appearances and different features may also be utilized with the present subject matter as well.

Cabinet 12 includes a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation about a substantially horizontal axis. Drum 26 defines a chamber 25 for receipt of articles of clothing for drying. Drum 26 extends between a front portion 37 and a back portion 38.

As used herein, the term "clothing" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance (e.g., clothes dryer) and may include a mixture of different or similar articles of clothing of different or similar types and kinds of fabrics, textiles, garments and linens within a particular laundering process.

A motor 31 is configured for rotating drum 26 about the horizontal axis, e.g., via a pulley and a belt (not shown). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles (e.g., baffles 27) are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

In some embodiments, each baffle 27 includes a baffle body 112 that defines a lifting face 114 and a non-lifting face 116. For example, in the instance in which the drum 26 rotates counter-clockwise from the perspective of a viewer situated in front of the opening 32, baffle 27 will have a lifting face 114. Likewise, in the instance in which the drum 26 rotates counter-clockwise from the perspective of a viewer situated in front of the opening 32, baffle 27 will have a non-lifting face 116. Thus, lifting face 114 and non-lifting face 116 may face opposite each other on each baffle 27. Optionally, a compartment 118 may be defined within the baffle body 112. For instance, compartment 118 may be defined between the lifting face 114 and the non-lifting face 116. As will be discussed further below, in some embodiments of the present disclosure, one or more appliance sensors 122 may be positioned on the lifting face 114 and/or non-lifting face 116 of each baffle 27. Furthermore, baffles having shapes other than those shown in FIG. 2 (see also FIGS. 3 and 4) may be used as well. Baffle body 112 may be a single, continuous piece of material, such as molded plastic, in certain exemplary embodiments. In other exemplary embodiments, baffle body 112 may include multiple discrete body portions mounted or fixed to one other in order to form baffle body 112.

In some embodiments, the drum may reverse rotational directions during portions of various drying operations. In such embodiments, for example, the face of each baffle that performs lifting functionality for a majority of the operation time may be designated as the lifting face. As another example, the face of each baffle that performs lifting functionality during a critical period in which sensing of load moisture content is most relevant and scrutinized (e.g., the final period of drying) may be designated as the lifting face.

Drum 26 also includes a back or rear wall 34, e.g., at back portion 38 of drum 26. Rear wall 34 may be fixed or may be rotatable. A supply duct 41 is mounted to rear wall 34 and receives heated air that has been heated by a heating assembly or system 40.

Motor 31 is also in mechanical communication with an air handler 48 such that motor 31 rotates a fan 49, e.g., a centrifugal fan, of air handler 48. Air handler 48 is configured for drawing air through chamber 25 of drum 26, e.g., in order to dry articles located therein. In alternative example embodiments, dryer appliance 10 may include an additional motor (not shown) for rotating fan 49 of air handler 48 independently of drum 26.

Drum 26 is configured to receive heated air that has been heated by a heating assembly 40, e.g., in order to dry damp articles disposed within chamber 25 of drum 26. For example, heating assembly 40 may include a heating element (not shown), such as a gas burner, an electrical resistance heating element, or heat pump, for heating air. As discussed above, during operation of dryer appliance 10, motor 31 rotates drum 26 and fan 49 of air handler 48 such that air handler 48 draws air through chamber 25 of drum 26 when motor 31 rotates fan 49. In particular, ambient air enters heating assembly 40 via an inlet 51 due to air handler 48 urging such ambient air into inlet 51. Such ambient air is heated within heating assembly 40 and exits heating assembly 40 as heated air. Air handler 48 draws such heated air through supply duct 41 to drum 26. The heated air enters drum 26 through a plurality of outlets of supply duct 41 positioned at rear wall 34 of drum 26.

Within chamber 25, the heated air may accumulate moisture, e.g., from damp clothing disposed within chamber 25. In turn, air handler 48 draws moisture saturated air through a screen filter (not shown) which traps lint particles. Such moisture statured air then enters an exit duct 46 and is passed through air handler 48 to an exhaust duct 52. From exhaust duct 52, such moisture statured air passes out of dryer appliance 10 through a vent 53 defined by cabinet 12. After the clothing articles have been dried, they are removed from the drum 26 via opening 32. A door 33 provides for closing or accessing drum 26 through opening 32.

One or more selector inputs 70, such as knobs, buttons, touchscreen interfaces, etc., may be provided or mounted on a cabinet backsplash a cabinet backsplash 71 and is in communication with a processing device or controller 56. Signals generated in controller 56 operate motor 31 and heating assembly 40 in response to the position of selector knobs 70. Alternatively, a touch screen type interface may be provided. As used herein, "processing device" or "controller" may refer to one or more microprocessors, microcontroller, ASICS, or semiconductor devices and is not restricted necessarily to a single element. The controller may be programmed to operate dryer appliance 10 by executing instructions stored in memory. The controller may include, or be associated with, one or more memory elements such as for example, RAM, ROM, or electrically erasable, programmable read only memory (EEPROM). For example, the instructions may be software or any set of instructions that when executed by the processing device, cause the processing device to perform operations.

Figure 3:
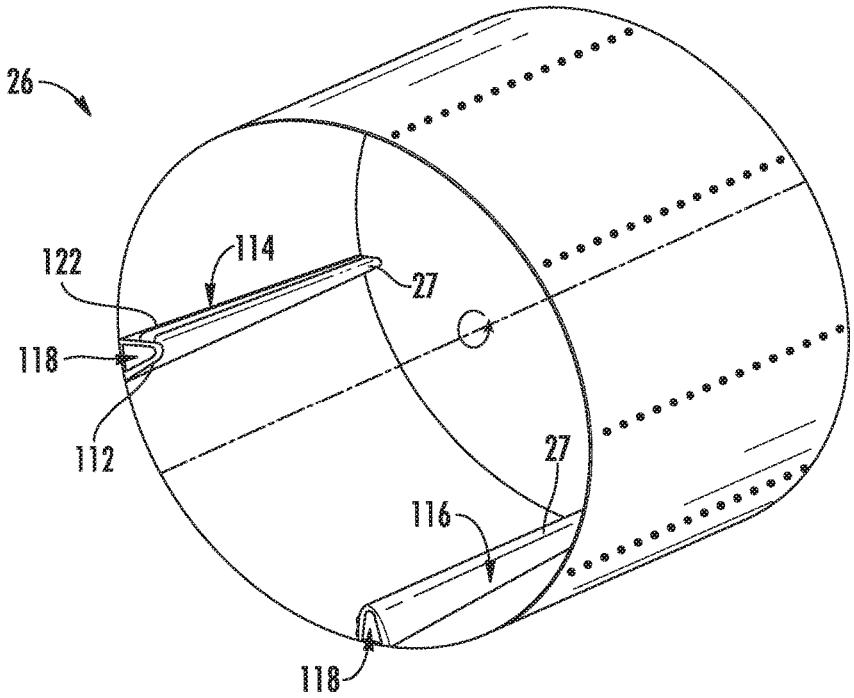
FIG. 3 provides a perspective view of the drum of the example dryer appliance of FIG. 2.
Figure 4:
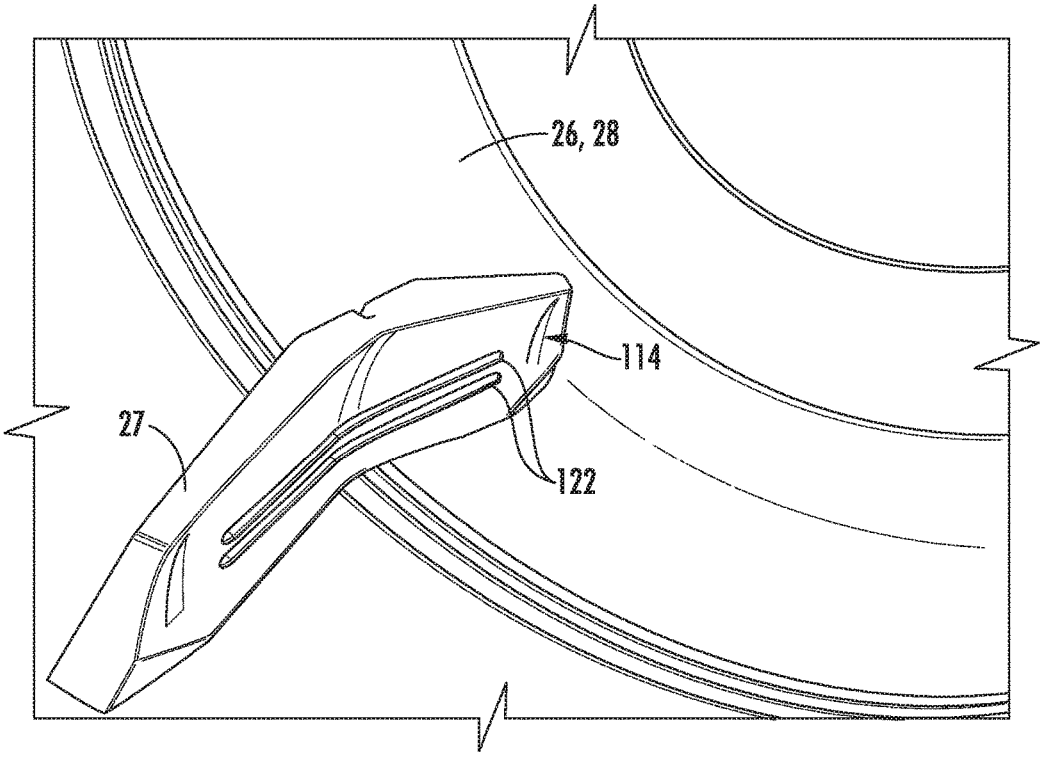
FIG. 4 provides a perspective view of a portion of the sensor assembly, including a baffle, of the example dryer appliance of FIG. 2.

FIG. 3 provides a simplified illustration of a first example sensor placement according to an example embodiment of the present disclosure. As shown, an appliance sensor 122 may be positioned on a baffle body 112. In particular, the first example sensor placement includes one of a plurality of appliance sensors 122 placed on the lifting face 114 of each of a plurality of baffles 27 included in a drum 26 of a dryer appliance 10. As an example, appliance sensor 122 (e.g., a pair of conductive rods, as illustrated in FIG. 4) is positioned on a lifting face 114 of baffle 27. Optionally, multiple discrete sensors may be provided on a single baffle.

Other sensor placements may be used as well. As an example, in other embodiments, the plurality of sensors is placed on the non-lifting faces of the plurality of baffles instead of the lifting faces. As another example, the plurality of sensors may be placed on both the lifting faces and the non-lifting faces. As yet another example, a conductive (e.g., metallic) coating or cladding covering two different portions of the surface of each baffle may serve as the plurality of sensors.

FIGS. 4 through 8 provide an example of a sensor system or assembly 110 that includes sensor housing, such as a lifter or baffle 27, to support and/or enclose one or more components of the assembly 110. As described above, a baffle 27 may include a baffle body 112 defining a lifting face 114 and a non-lifting face 116. A compartment 118 is generally defined within baffle body 112 between lifting face 114 and non-lifting face 116. In some embodiments, one or more appliance sensors 122 are positioned on baffle body 112. For instance, a portion of appliance sensor 122 may be embedded within baffle body 112, while another portion is uncovered to communicate with compartment 118. Appliance sensor 122 may be any suitable sensor for sensing one or more parameters of clothing inside a drum 26 of the dryer appliance 10. For example, appliance sensors 122 may be moisture sensors (as shown), dryness sensors, relative humidity sensors, clothing temperature sensors, air temperature sensors, or other suitable sensors.

A wireless transmission tag 124 is generally positioned inside baffle 27, e.g., within compartment 118. As shown, wireless transmission tag 124 is provided in communication within appliance sensor 122. For instance, wireless transmission tag 124 may be electrically coupled to appliance sensor 122 through a communication line, e.g., a conductive wire, conduit, or bus. Advantageously, wireless transmission tag 124 and appliance sensor 122 may be disposed entirely within rotatable drum 26, thereby avoiding interfering with rotation of drum 26 and/or the increasing the clearance required to mount drum 26.

A wireless tag reader 126 is provided in operable communication with wireless transmission tag 124. As will be described in detail below, wireless tag reader 126 is generally positioned outside of baffle 27 and drum 26. Both of wireless transmission tag 124 and wireless tag reader 126 are matched in wireless communication, e.g., connected to the same wireless network. Both wireless transmission tag 124 and wireless tag reader 126 may share a layer protocol architecture, such as BLUETOOTH®, that is adapted for short-wavelength ultra-high frequency (UHF) communications in a band between 2.4 GHz and 2.485 GHz (e.g., according to the IEEE 802.15.1 standard). For instance, wireless transmission tag 124 may be a BLUETOOTH® slave board while wireless tag reader 126 is a BLUETOOTH® master board.

In some embodiments, a sealed container 128 encloses wireless transmission tag 124, e.g., within compartment 118. Sealed container 128 may secure wireless transmission tag 124 such that wireless transmission tag 124 is fixed relative to baffle body 112. Moreover, sealed container 128 may prevent or restrict moisture from entering sealed container 128 and/or interfering with one or more electrical components of wireless transmission tag 124. Example embodiments of sealed container 128 include potting, such as an insulating fire-retardant urethane material, that surrounds wireless transmission tag 124 and substantially fills a portion of compartment 118. Additionally or alternatively, sealed container 128 may include a discrete resealable case (not pictured) to receive wireless transmission tag 124 and selectively close or open. In some such embodiments, resealable case may include one or more mechanical fasteners (e.g., snaps, clips, screws, etc.) to selectively mount resealable case to baffle body 112 within compartment 118.

Figure 9:
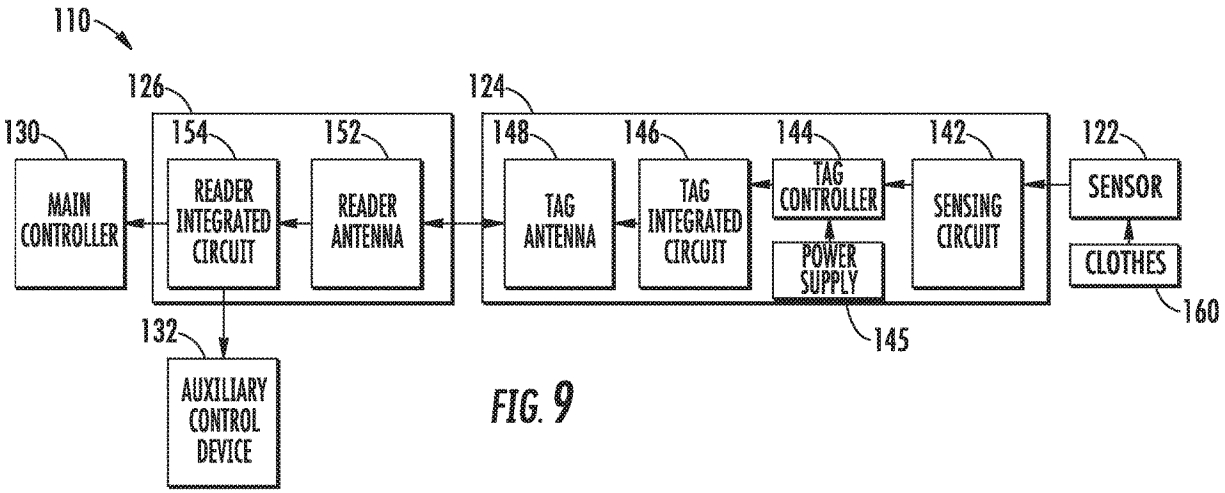
FIG. 9 provides a block-diagram of a sensor assembly according to an example embodiment of the present disclosure.
Figure 10:
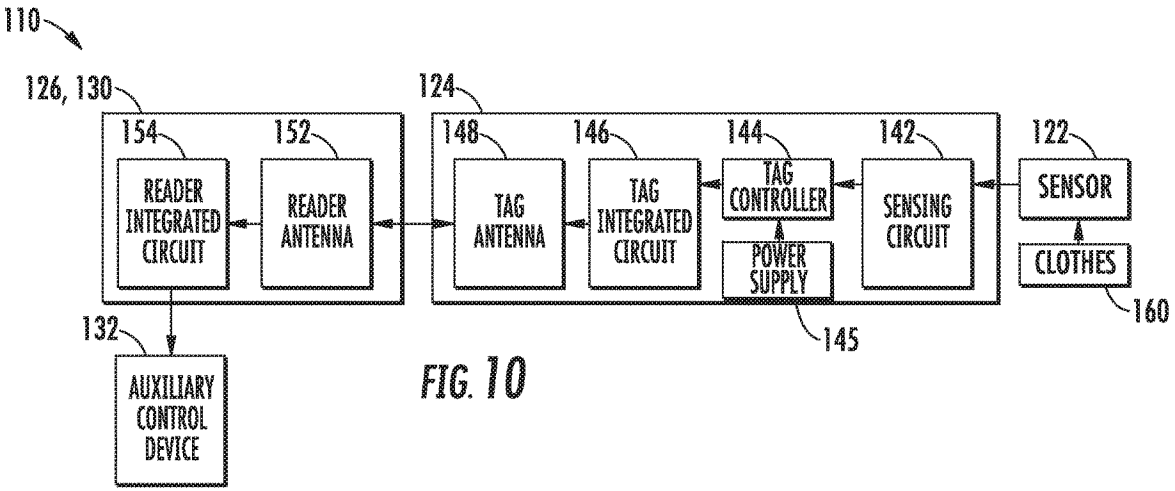
FIG. 10 provides a block-diagram of sensor assembly according to another example embodiment of the present disclosure.

FIGS. 9 and 10 depict block-diagrams of two example embodiments of sensor assembly 110. In particular, FIGS. 9 and 10 depict example configurations for the flow of condition data in assembly 110. As illustrated, assembly 110 may include a main controller 130, a wireless tag reader 126, a wireless transmission tag 124, an auxiliary control device 132, and one or more appliance sensors 122.

As described above, appliance sensor 122 may be any suitable sensor for sensing one or more parameters of clothing inside a drum 26 of the dryer appliance 10. For example, appliance sensor 122 may be a moisture sensor, dryness sensor, relative humidity sensor, clothing temperature sensor, air temperature sensor, or another suitable sensor.

As an example, each appliance sensor 122 may be a conductivity sensor such as two conductive (e.g., metallic) rods in parallel, two conductive strips in parallel, or two different metal coatings on a baffle surface. Each conductivity sensor may be used to measure moisture content of the clothing or other parameters such as clothing surface temperature. In particular, in some embodiments, each appliance sensor 122 (e.g., each pair of conductive rods) may provide an output signal (e.g., voltage signal or current signal) corresponding to conductivity or resistance of clothes under drying indicating a stage of drying (i.e., drying level) versus time. The resistance/voltage decreases compared to a reference voltage when clothing with moisture simultaneously contacts any or all of the sensor pairs. The resistance/voltage may correspond to a differential across the rods, strips, coatings, etc.

Furthermore, the amount by which the voltage decreases when clothing with moisture simultaneously contacts the two conductive portions may be proportional to the amount of moisture contained within the clothing. Therefore, in some embodiments, one of the conductive portions of the appliance sensor 122 may be held at a predetermined voltage (e.g., five volts). The voltage at such conductive portion will experience a decrease when clothing with moisture contacts both conductive portions. Such decrease will be proportional to the amount of moisture and will be reflected in the output signal.

As will be described in detail below, each of the appliance sensors 122 may be wired together to provide a single, combined output signal. Thus, the combined output signal will reflect clothing parameters for the entirety of the drum 26 (FIG. 2). The combined output signal may be provided to wireless transmission tag 124. In further embodiments, appliance sensors 122 may be organized into two or more groupings (e.g., based on sensor type or sensor position) that respectively provide two or more combined output signals to wireless transmission tag 124.

Wireless transmission tag 124 may include circuitry or other components for receiving the output signal from appliance sensors 122, converting the output signal from analog to digital, and then storing the data in a local memory (e.g., an EEPROM). In particular, wireless transmission tag 124 may include a sensing circuit 142, a tag controller 144, a power supply 145, a tag integrated circuit (IC) 146, and a tag antenna 148.

Figure 5:
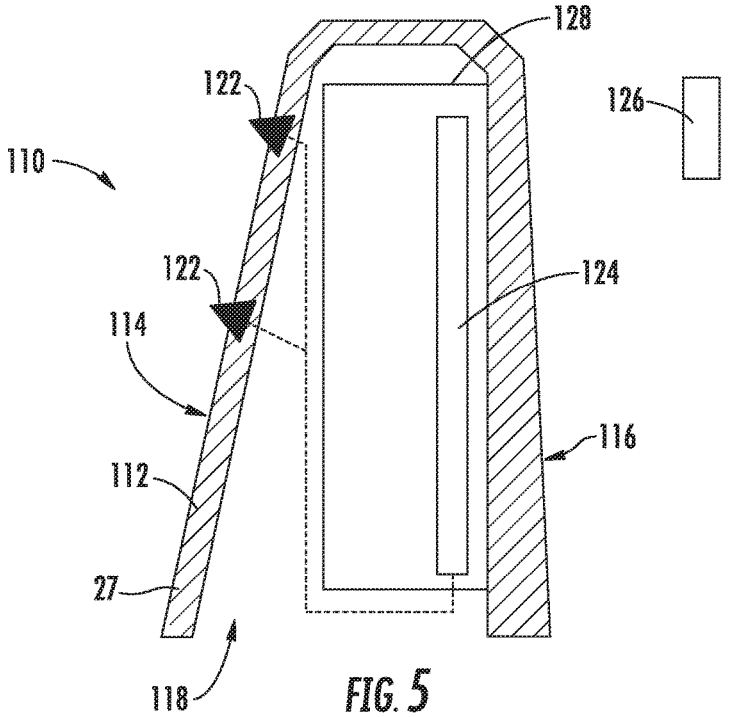
FIG. 5 provides a schematic side view of a compartment within the example baffle, wherein a wireless transmission tag has been positioned therein, according to the example embodiment of FIG. 4.
Figure 6:
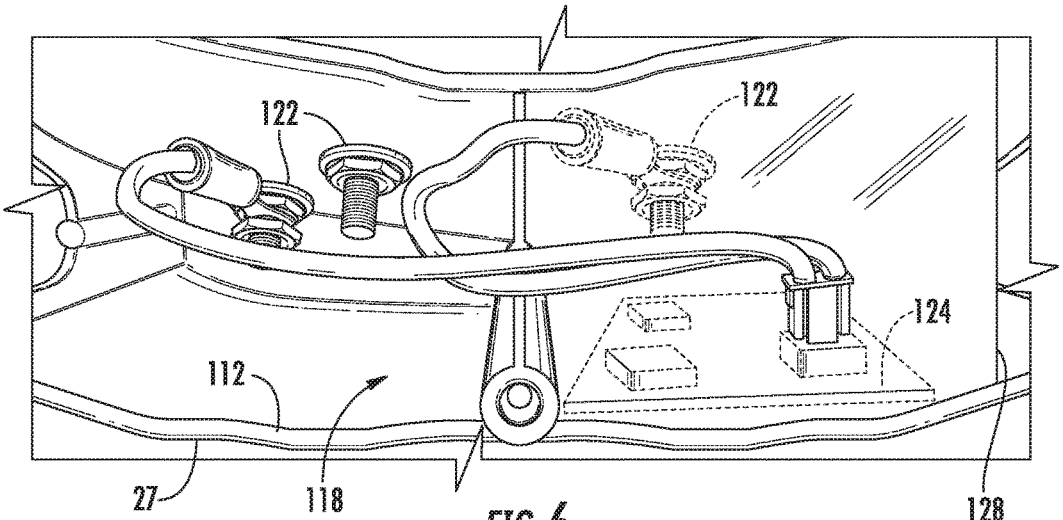
FIG. 6 provides a perspective view of a compartment within the example baffle, including a sealed container for a wireless transmission tag, according to the example embodiment of FIG. 4.
Figure 7:
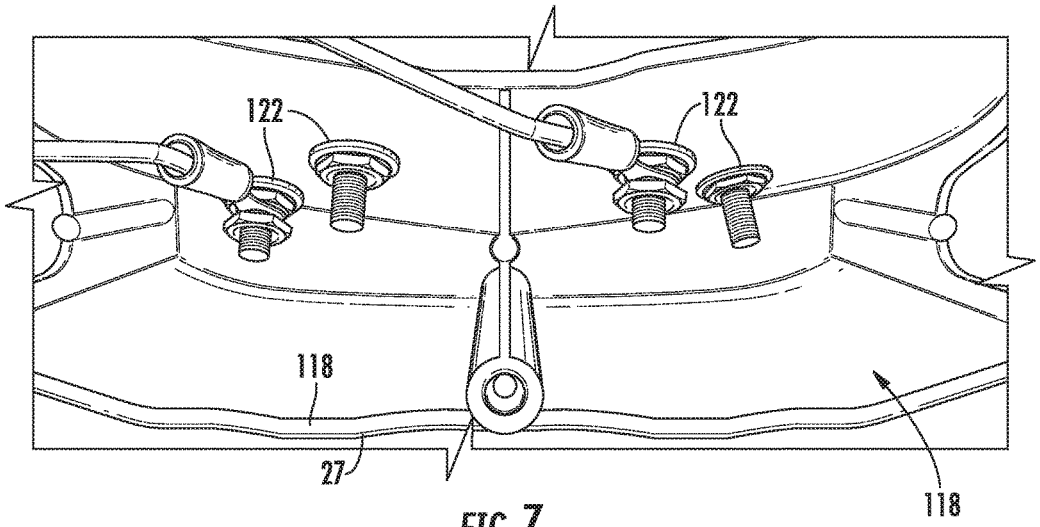
FIG. 7 provides a perspective view of a compartment within the example baffle, wherein a wireless transmission tag has been removed, according to the example embodiment of FIG. 4.
Figure 8:
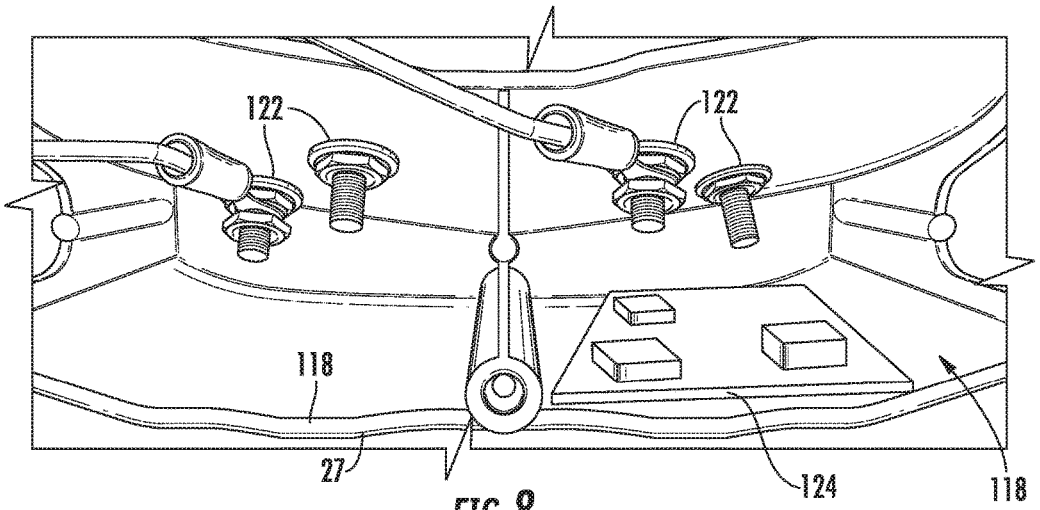
FIG. 8 provides a perspective view of a compartment within the example baffle, wherein a wireless transmission tag has been positioned therein, according to the example embodiment of FIG. 4.

As described above, wireless transmission tag 124 may be mounted within a baffle 27 (FIG. 5), such as within the compartment 118 (FIG. 5) defined by a baffle body 112 (FIG. 5). A power supply 145 may be electrically coupled to wireless transmission tag 124 to provide excitation energy to both appliance sensors 122 and some or all of the other components of wireless transmission tag 124. Power supply 145 may be any suitable component for providing energy. In some embodiments, the power supply 145 may be a battery, such as a small, coin-type battery. Optionally, power supply 145 may be physically included within wireless transmission tag 124. Additionally or alternatively, power supply 145 may be an energy-harvesting component. For instance, power supply 145 may include a piezoelectric membrane configured to harvest electricity from mechanical strain (e.g., strain induced by gravitational forces during rotation of drum 26).

Wireless tag reader 126 may include components and associated circuitry for obtaining condition data stored at wireless transmission tag 124 and then providing the obtained condition data to the main controller 130. In particular, wireless tag reader 126 may include a reader antenna 152 and a reader integrated circuit (IC) 154.

Wireless tag reader 126 may be secured to the cabinet of the dryer appliance 10 so that it is stationary relative to cabinet 12 during operation of dryer appliance 10. Specifically, wireless tag reader 126 may be positioned remote, non-adjacent or apart from a rotational path of wireless transmission tag 124 or drum. Therefore, data transfer between wireless transmission tag 124 and wireless tag reader 126 may occur regardless of the position of wireless transmission tag 124 along the rotational path of the drum 26 (FIG. 2).

As an example implementation of the assembly 110, the sensing/control process may begin with appliance sensors 122 measuring, e.g., moisture values of clothes 160 present in the drum 26 (FIG. 2) of the dryer appliance 10 (FIG. 2). For example, appliance sensors 122 may output an analog signal describing a voltage between conductive portions of appliance sensors 122.

Next, wireless transmission tag 124 may receive analog condition data from appliance sensors 122 via the sensing circuit 142. The tag controller 144 may convert the analog condition data into digital condition data and may store the digital condition data in a memory included in the tag IC 146 (e.g., an EEPROM included within the tag IC 146).

Generally wireless transmission tag 124 and wireless tag reader 126 are able to communicate via signals transmitted over a shared wireless communications network. For instance, wireless tag reader 126 may receive the digital condition data from wireless transmission tag 124 through one or more signals transmitted by wireless transmission tag 124. Wireless tag reader 126 may further provide the obtained condition data to the main controller 130. Transmission of signals from wireless transmission tag 124 may occur continuously, along predetermined intervals, or in response to one or more interrogation signals received from wireless tag reader 126.

Main controller 130 is a "processing device" or "controller" and may be embodied as controller 56, described above with respect to FIGS. 1 and 2. Main controller 130 may control a dryer appliance 10 based on the condition data received from wireless tag reader 126. As an example, main controller 130 may determine a moving average of the condition data, compare the moving average to a threshold value, and when the moving average of the condition data exceeds the threshold value, de-energize a heater of the dryer appliance 10. Thus, the dryer appliance 10 may be stopped upon sensing that the moisture level is satisfactory, thereby preventing over-drying or under-drying conditions. By avoiding over-drying, wear and tear on the clothing may be reduced, energy consumption may be improved, and service calls due to overheating of clothing may be avoided.

Auxiliary control device 132 may be embodied as a discrete processing unit, such as a smart phone, tablet, or laptop computer. Generally, auxiliary control device 132 is in wireless communication with wireless tag reader 126. Both wireless tag reader 126 and auxiliary control device 132 may share a layer protocol architecture, such as wireless tag reader 126, that is adapted for short-wavelength ultra-high frequency (UHF) communications in a band between 2.4 GHz and 2.485 GHz (e.g., according to the IEEE 802.15.1 standard). The shared layer protocol architecture between wireless tag reader 126 and auxiliary control device 132 may be the same as the shared layer protocol architecture between wireless transmission tag 124 and wireless tag reader 126. During operations, auxiliary control device 132 may receive data from wireless control device and display information about performance of the dryer appliance 10, e.g., based on the received data. For instance, auxiliary control device 132 may display information concerning the moisture level of clothes as detected by sensing circuit 142.

Although FIG. 9 illustrates main controller 130 as a discrete unit, separate from wireless tag reader 126, other embodiments include main controller 130 integral with wireless tag reader 126, as illustrated in FIG. 10.

Figure 11:
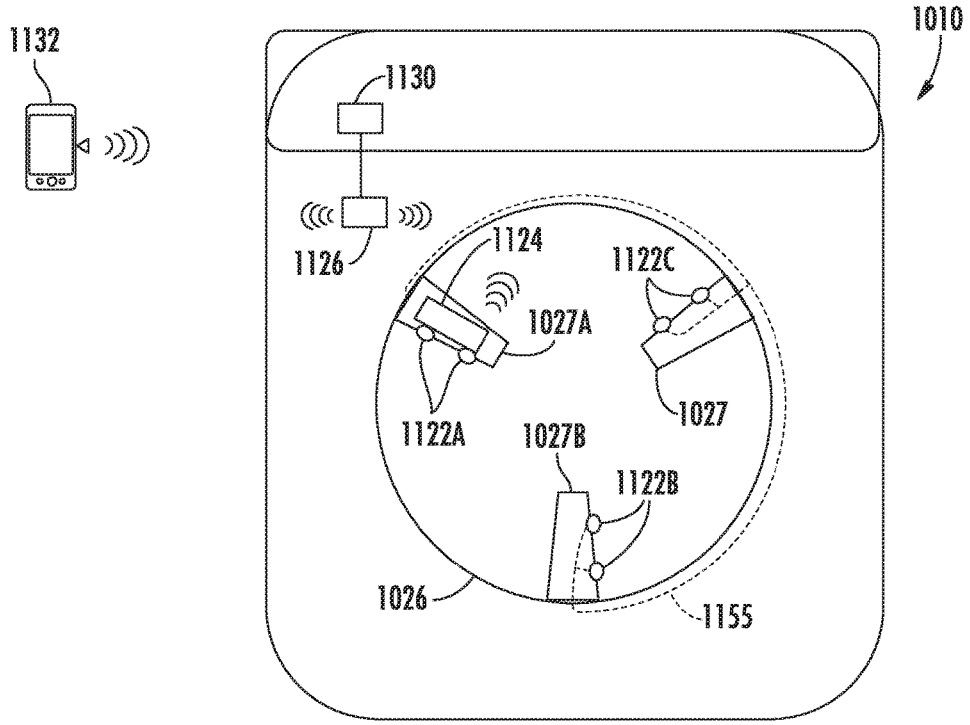
FIG. 11 provides a schematic view of a dryer appliance and sensor assembly according to an example embodiment of the present disclosure.
Figure 12:
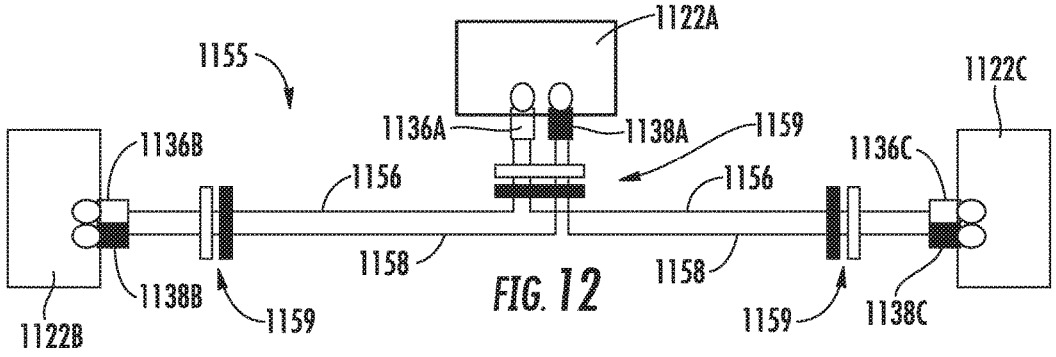
FIG. 12 provides a schematic view of a portion of the sensor assembly of FIG. 11.

Turning to FIGS. 11 and 12, an example dryer appliance 1010 is illustrated. It is understood that the example dryer appliance 1010 is substantially identical to the dryer appliance 10 described above, except as otherwise indicated.

As shown, some embodiments of dryer appliance 1010 include a plurality of appliance sensors 1122A, 1122B, 1122C disposed on a plurality of baffles 1027A, 1027B, 1027C within a rotatable drum 1026. Each baffle 1027A, 1027B, 1027C may include a discrete sensor 1122A, 1122B, 1122C mounted thereto, as described above. A wireless transmission tag 1124, e.g., a single wireless transmission tag 1124 for the dryer appliance 1010, may be positioned within a compartment of one baffle 1027A.

Wireless transmission tag 1124 may be in communication with each sensor 1122A, 1122B, 1122C. For instance, wireless transmission tag 1124 may be electrically coupled with sensor(s) 1122A mounted on the same baffle 1027A, as well as additional sensor(s) 1122B, 1122C mounted to separate baffle(s) 1027B, 1027C. In other words, wireless transmission tag 1124 may communicate with sensors 1122A, 1122B, 1122C within multiple discrete baffles 1027A, 1027B, 1027C. During operation, wireless transmission receives unique electrical signals (e.g., electrical signals related to moisture data) from each discrete sensor 1122A, 1122B, 1122C.

An electrical harness 1155 may connect wireless transmission tag 1124 to the various sensors 1122A, 1122B, 1122C. Specifically, electrical harness 1155 may be electrically coupled to wireless transmission tag 1124 and each of the plurality of sensors 1122A, 1122B, 1122C. In some embodiments, electrical harness 1155 electrically couples the sensors 1122A, 1122B, 1122C together in parallel. A first line 1156 of electrical harness 1155 may connect a negative terminal 1134A, 1134B, 1134C of each sensor 1122A, 1122B, 1122C, while a second line 1158 of electrical harness 1155 may connect a positive terminal 1136A, 1136B, 1136C of each sensor 1122A, 1122B, 1122C. One or more mounting brackets 1159 may secure the lines 1156, 1158 to rotatable drum 1026. In turn, as drum 1026 rotates, electrical harness 1155 will move in unison with rotatable drum 1026.

Wireless transmission tag 1124 may further be in operable communication (e.g., wireless communication) with wireless tag reader 1126. Wireless tag reader 1126 may be electrically coupled to a main controller 130 of dryer appliance 1010 that is mounted away from the rotatable drum 1026. After condition data has been received from the sensors 1122A, 1122B, 1122C, wireless transmission tag 1124 may transmit the condition data to wireless tag reader 1126. Wireless tag reader 1126 may subsequently transmit the condition data to a main controller 130 (e.g., as an electrical signal). As described above, wireless transmission tag 1124 and wireless tag reader 1126 may share a layer protocol architecture, such as BLUETOOTH®, to communicate over the same wireless network. Advantageously, wireless tag reader 1126 may be mounted at a significantly spaced distance from wireless transmitter tag (and thereby at a distance from rotatable drum 1026), e.g., at a distance greater than would be possible with near field communications (NFC) networks. Additionally or alternatively, wireless tag reader 1126 may be wirelessly connected to an auxiliary control device 1132 that is separate and spaced apart from the cabinet of dryer appliance 1010.

Although multiple sensors are shown, it is understood that the dryer appliance 1010 of FIG. 12 may include even a single wireless transmission tag 1124 that is electrically coupled to a single sensor (e.g., 1122A). In other words, a sensor may be absent from certain baffles (e.g., baffles 1027B, 1027C).

Figure 13:
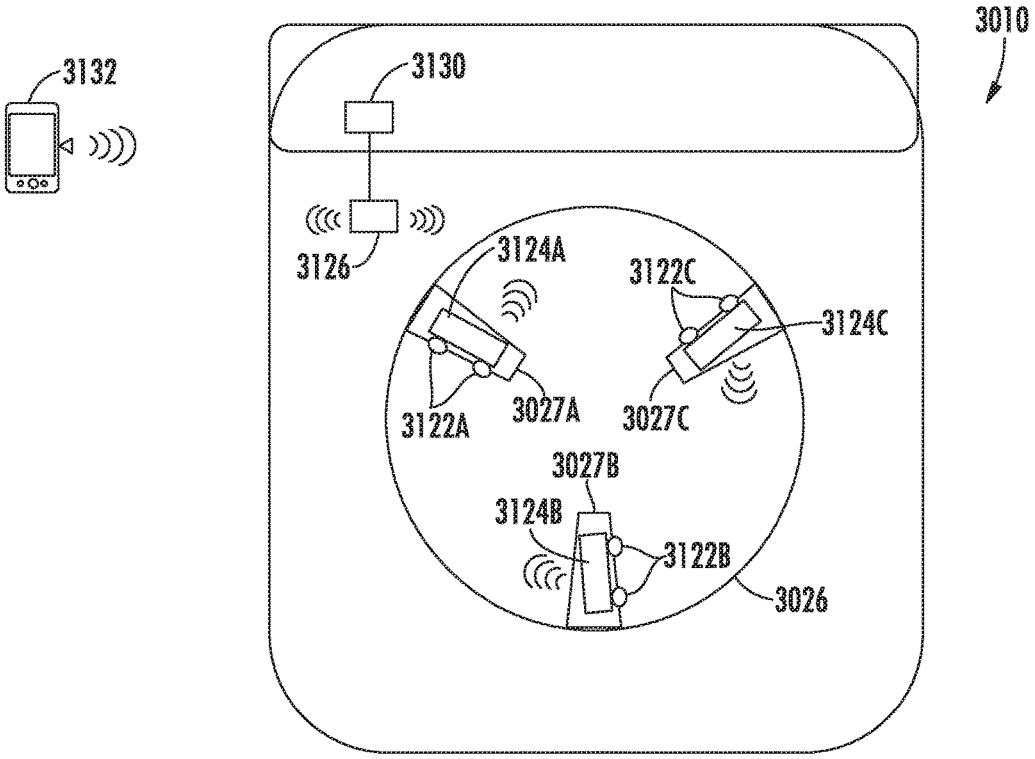
FIG. 13 provides a schematic view of a dryer appliance and sensor assembly according to another example embodiment of the present disclosure.

Turning to FIG. 13, another example dryer appliance 3010 is illustrated. It is understood that the example dryer appliance 3010 is substantially identical to the dryer appliances described above, except as otherwise indicated.

As shown, some embodiments of dryer appliance 3010 include a plurality of appliance sensors 3122A, 3122B, 3122C disposed on a plurality of baffles 3027A, 3027B, 3027C within a rotatable drum 3026. Each baffle 3027A, 3027B, 3027C may include a discrete sensor 3122A, 3122B, 3122C mounted thereto, as described above. Moreover, a separate wireless transmission tag 3124A, 3124B, 3124C may be positioned within a compartment of each discrete baffle 3027A, 3027B, 3027C.

Each wireless transmission tag 3124A, 3124B, 3124C may be in communication (e.g., electrically coupled) with a respective sensor 3122A, 3122B, 3122C. For instance, wireless transmission tag 3124A may be electrically coupled to sensor(s) 3122A mounted on the same baffle 3027A. Each additional wireless transmission tag 3124B, 3124C may be electrically coupled to respective additional sensor(s) 3122B, 3122C. In other words, each wireless transmission tag 3124A, 3124B, 3124C may communicate with sensors 3122A, 3122B, 3122C within a corresponding baffles 3027A, 3027B, 3027C. During operation, one or more of wireless transmission tags 3124A, 3124B, 3124C receive unique electrical signals (e.g., electrical signals related to moisture data) from a corresponding sensor 3122A, 3122B, 3122C.

Wireless tag reader 3126 may be in operable communication (e.g., wireless communication) with each wireless transmission tag 3124A, 3124B, 3124C. Wireless tag reader 3126 may be electrically coupled to a main controller 3130 of dryer appliance 3010 that is mounted away from the rotatable drum 3026. After condition data has been received from a sensor 3122A, 3122B, 3122C, a respective wireless transmission tags 3124A, 3124B, 3124C may transmit the condition data to wireless tag reader 3126. Wireless tag reader 3126 may subsequently transmit the condition data to a main controller 3130 (e.g., as an electrical signal). As described above, wireless transmission tags 3124A, 3124B, 3124C and wireless tag reader 3126 may share a layer protocol architecture, such as BLUETOOTH®, to communicate over the same network. Advantageously, wireless tag reader 3126 may be mounted at a significantly spaced distance from wireless transmitter tags 3124A, 3124B, 3124C (and thereby at a distance from rotatable drum 3026), e.g., at a distance greater than would be possible with near field communications (NFC) networks. Additionally or alternatively, wireless tag reader 3126 may be wirelessly connected to an auxiliary control device 3132 that is separate and spaced apart from the cabinet of dryer appliance 3010, as described above.

Figure 14:
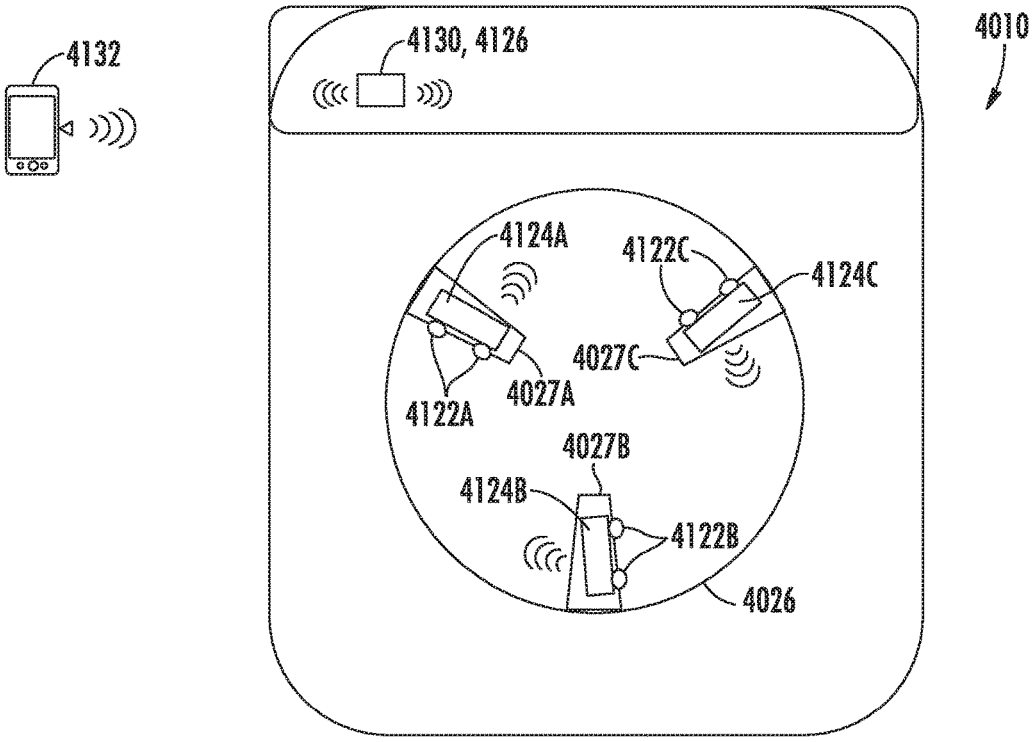
FIG. 14 provides a schematic view of a dryer appliance and sensor assembly according to yet another example embodiment of the present disclosure.

Turning to FIG. 14, yet another example dryer appliance 4010 is illustrated. It is understood that the example dryer appliance 4010 is substantially identical to the dryer appliances described above, except as otherwise indicated.

As shown, some embodiments of dryer appliance 4010 include a plurality of appliance sensors 4122A, 4122B, 4122C disposed on a plurality of baffles 4027A, 4027B, 4027C within a rotatable drum 4026. Each baffle 4027A, 4027B, 4027C may include a discrete sensor 4122A, 4122B, 4122C mounted thereto, as described above. Moreover, a separate wireless transmission tag 4124A, 4124B, 4124C may be positioned within a compartment of each discrete baffle 4027A, 4027B, 4027C.

Each wireless transmission tag 4124A, 4124B, 4124C may be in communication (e.g., electrically coupled) with a respective sensor 4122A, 4122B, 4122C. For instance, wireless transmission tag 4124A may be electrically coupled to sensor(s) 4122A mounted on the same baffle 4027A. Each additional wireless transmission tag 4124B, 4124C may be electrically coupled to respective additional sensor(s) 4122B, 4122C. In other words, each wireless transmission tag 4124A, 4124B, 4124C may communicate with sensors 4122A, 4122B, 4122C within a corresponding baffles 4027A, 4027B, 4027C. During operation, one or more of wireless transmission tags 4124A, 4124B, 4124C receive unique electrical signals (e.g., electrical signals related to moisture data) from a corresponding sensor 4122A, 4122B, 4122C.

Although not shown, it is understood that the dryer appliance 4010 of FIG. 14 may, additionally or alternatively, include a single wireless transmission tag and electrical harness to electrically couple a single wireless transmission tag (e.g., 4124A) to the sensors 4122A, 4122B, 4122C, as illustrated in FIG. 12. Moreover, although multiple sensors are shown, it is understood that the dryer appliance 4010 of FIG. 14 may include even a single wireless transmission tag (e.g., 4124A) that is electrically coupled to a single sensor (e.g., 4122A). In other words, a wireless transmission tag and/or sensor may be absent from certain baffles (e.g., baffles 4027B, 4027C).

Wireless tag reader 4126 may be in operable communication (e.g., wireless communication) with each wireless transmission tag 4124A, 4124B, 4124C. Wireless tag reader 4126 may be integrated with a main controller 4130 of dryer appliance 4010 that is mounted away from the rotatable drum 4026. For instance, main controller 4026 and wireless tag reader 4126 may be mounted within a backsplash and/or control panel of dryer appliance 4010. After condition data has been received from a sensor 4122A, 4122B, 4122C, a respective wireless transmission tag 4124A, 4124B, 4124C may transmit the condition data to wireless tag reader 4126. As described above, wireless transmission tags 4124A, 4124B, 4124C and wireless tag reader 4126 may share a layer protocol architecture, such as BLUETOOTH®, to communicate over the same network. Advantageously, wireless tag reader 4126 may be mounted at a significantly spaced distance from wireless transmitter tags 4124A, 4124B, 4124C (and thereby at a distance from rotatable drum 4026), e.g., at a distance greater than would be possible with near field communications (NFC) networks. Additionally or alternatively, wireless tag reader 4126 may be wirelessly connected to an auxiliary control device 4132 that is separate and spaced apart from the cabinet of dryer appliance 4010, as described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A sensor assembly to a dryer appliance, the sensor assembly comprising:

a baffle comprising a baffle body defining a lifting face and a non-lifting face, a compartment being defined within the baffle body between the lifting face and the non-lifting face;

an appliance sensor positioned on the baffle body;

a wireless transmission tag positioned within the compartment, the wireless transmission tag in communication with the appliance sensor; and a wireless tag reader in operable communication with the wireless transmission tag.

2. The sensor assembly of claim 1, further comprising:

a plurality of additional baffles; and a plurality of additional sensors, each additional sensor of the plurality of additional sensors disposed on a respective one of the plurality of additional baffles.

3. The sensor assembly of claim 2, further comprising an electrical harness electrically coupled to the wireless transmission tag and each of the plurality of additional sensors.

4. The sensor assembly of claim 2, further comprising multiple additional wireless transmission tags, wherein each additional wireless transmission tag is positioned within a discrete additional baffle, wherein each additional sensor is electrically coupled to a discrete wireless transmission tag, and wherein the wireless tag reader is in operable communication with each additional wireless transmission tag.

5. The sensor assembly of claim 1, further comprising a sealed container enclosing the wireless transmission tag within the compartment.

6. The sensor assembly of claim 1, wherein the wireless transmission tag comprises a tag controller configured to convert an electrical signal received from the appliance sensor into digital condition data transmitted to the wireless tag reader.

7. The sensor assembly of claim 6, wherein the wireless transmission tag further comprises a power supply electrically coupled to the tag controller.

8. The sensor assembly of claim 6, wherein the appliance sensor includes a pair of conductive rods to detect moisture within a drum of the dryer appliance.

9. The sensor assembly of claim 6, wherein the wireless tag reader is in operable communication with an auxiliary control device, and wherein the wireless tag reader is configured to transmit the digital condition data to the auxiliary control device.

10. A dryer appliance comprising:

a cabinet;

a drum rotatably mounted within the cabinet, the drum defining a space for the receipt of clothes for drying;

a sensor housing extending within the drum, the sensor housing defining a compartment within the space for the receipt of clothes;

an appliance sensor positioned on the sensor housing;

a wireless transmission tag positioned within the compartment in communication with the appliance sensor; and a wireless tag reader in operable communication with the wireless transmission tag.

11. The dryer appliance of claim 10, wherein the sensor housing is a baffle mounted to the drum, the baffle including a baffle body defining a lifting face and a non-lifting face, the compartment being defined within the baffle body between the lifting face and the non-lifting face.

12. The dryer appliance of claim 10, further comprising:

a plurality of additional baffles extending within the drum; and a plurality of additional sensors, each additional sensor of the plurality of additional sensors disposed on a respective one of the plurality of additional baffles.

13. The dryer appliance of claim 12, further comprising an electrical harness electrically coupled to the wireless transmission tag and each of the plurality of additional sensors.

14. The dryer appliance of claim 12, further comprising multiple additional wireless transmission tags, wherein each additional wireless transmission tag is positioned within a discrete additional baffle, wherein each additional sensor is electrically coupled to a discrete wireless transmission tag, and wherein the wireless tag reader is in operable communication with each additional wireless transmission tag.

15. The dryer appliance of claim 12, further comprising a sealed container enclosing the wireless transmission tag within the compartment.

16. The dryer appliance of claim 10, wherein the wireless transmission tag comprises a tag controller configured to convert an electrical signal received from the appliance sensor into digital condition data transmitted to the wireless tag reader.

17. The dryer appliance of claim 16, wherein the wireless transmission tag further comprises a power supply electrically coupled to the tag controller.

18. The dryer appliance of claim 16, wherein the appliance sensor includes a pair of conductive rods to detect moisture within the drum.

19. The dryer appliance of claim 10, further comprising a main controller in operable communication with the wireless tag reader to receive condition data from the wireless transmission tag, wherein the main controller is configured to control operation of the dryer appliance based on the condition data received from the wireless transmission tag.

20. The dryer appliance of claim 16, wherein the wireless tag reader is in operable communication with an auxiliary control device, and wherein the wireless tag reader is configured to transmit the digital condition data to the auxiliary control device.

* * * * *